US007242303B2

(12) United States Patent
Patel et al.

(10) Patent No.: US 7,242,303 B2
(45) Date of Patent: Jul. 10, 2007

(54) NAVIGATION AND COORDINATION DURING EMERGENCIES

(75) Inventors: Labhesh Patel, Mountain View, CA (US); Shmuel Shaffer, Palo Alto, CA (US); Gebran Chahrouri, Menlo Park, CA (US); Shantanu Sarkar, San Jose, CA (US); Bruce Moon, Dublin, CA (US); Joseph Khouri, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 193 days.

(21) Appl. No.: 11/073,245

(22) Filed: Mar. 4, 2005

(65) Prior Publication Data

US 2006/0208888 A1 Sep. 21, 2006

(51) Int. Cl.
*G08B 13/14* (2006.01)

(52) U.S. Cl. ..... 340/572.4; 340/572.1; 340/573.1; 340/539.13

(58) Field of Classification Search ..... 340/572, 340/572.1, 539.18, 539.13, 573.1, 524, 525, 340/537.4, 829.49
See application file for complete search history.

(56) References Cited

U.S. PATENT DOCUMENTS 4,688,026 A * 8/1987 Scribner et al. ..... 235/385
5,339,073 A 8/1994 Dodd et al.
5,646,616 A * 7/1997 Komatsu ..... 340/988
5,850,187 A 12/1998 Carrender et al.
5,887,176 A 3/1999 Griffith et al.
6,300,903 B1 * 10/2001 Richards et al. ..... 342/450
6,553,489 B1 4/2003 Osler et al.
6,963,282 B1 * 11/2005 Yeates et al. ..... 340/572.4
7,064,660 B2 * 6/2006 Perkins et al. ..... 340/539.13
2004/0021569 A1 * 2/2004 Lepkofker et al. ..... 340/568.1
2004/0061646 A1 * 4/2004 Andrews et al. ..... 342/463

OTHER PUBLICATIONS

International Search Report dated Jul. 13, 2006 from related PCT patent application No. PCT/US05/16319, including Notification of Transmittal.

Written Opinion of the International Searching Authority dated Jul. 13, 2006, from related PCT patent application No. PCT/US05/16319.

International Search Report dated Feb. 17, 2006, from related International Application No. PCT/US05/15322, 5 pp. including Notification of Transmittal.

(Continued)

*Primary Examiner*—Jeffery Hofsass
*Assistant Examiner*—Hoi C. Lau
(74) *Attorney, Agent, or Firm*—Beyer Weaver LLP.

(57) ABSTRACT

The present invention includes methods and devices for providing. According to some implementations, radio frequency identification ("RFID") tags are positioned at various locations throughout a building. Building locations can be determined from the RFID tags. Emergency service providers may be equipped with a portable device that includes at least one RFID reader for reading the RFID tags. Some implementations involve transmitting the RFID tag data to a control center from which the emergency services are coordinated. The emergency service workers' current and prior locations can be determined by the portable devices and/or at the control center. In preferred implementations, emergency service provider location information can be provided to control center personnel and to emergency service providers in real time.

21 Claims, 9 Drawing Sheets

OTHER PUBLICATIONS

Written Opinion of the International Searching Authority dated Feb. 17, 2006, from related International Application No. PCT/US05/15322, 3 pp.

AeroScout Visibility System: Bridging the Gap Between Wi-Fi, Active RFID and Telemetry, AeroScout Enterprise Visibility Solutions, http://www.aeroscout.com/content.asp?page=SystemOverview, printed Apr. 16, 2005, 3 pages.

WhereNet, Products, http://wherenet.com/products_main.html, printed Apr. 16, 2005, 2 pages.

R. Droms, *Dynamic Host Configuration Protocol*, http://www.ietf.org/rfc/, Bucknell University, Mar. 1997 (RFC 2131), printed Mar. 24, 2005, 43 pages.

S. Alexander et al., *DHCP Options and BOOTP Vendor Extensions*, http://www.ietf.org/rfc/, Silicon Graphics, Inc., Mar. 1997 (RFC 2132), printed Mar. 24, 2005, 32 pages.

G. Stump et al., *The User Class Option for DHCP*, http://www.ietf.org/rfc/, IBM, Nov. 2000 (RFC 3004), printed Mar. 24, 2005, 6 pages.

Y. T'Joens, *DHCP Reconfigure Extension*, http://www.ietf.org/rfc/, Alcatel, Dec. 2001, printed Mar. 24, 2005 (RFC 3203), 6 pages.

M. Patrick, *DHCP Relay Agent Information Option*, http://www.ietf.org/rfc/, Motorola BCS, Jan. 2001 (RFC 3046), printed Mar. 24, 2005, 14 pages.

EPCgl, *Frequently Asked Questions*, http://www.epcglobalinc.com/about/faqs.html, printed Mar. 24, 2005, 9 pages.

M. Johnston, *DHCP Preboot Execution Environment (PXE) Options draft-ietf-dhc-pxe-options-01.txt*, Dynamic Host Configuration Working Group, Intel Corporation, Jan. 21, 2005, 7 pages.

R. Johnson, *TFTP Server Address DHCP Option draft-raj-dhc-tftp-addr-option-00.txt*, Network Working Group, Cisco Systems, Inc., Feb. 6, 2005, 7 pages.

J. Littlefield, *Vendor-Identifying Vendor Options for Dynamic Host Configuration Protocol version 4 (DPHCPv4)*, Network Working Group, Request for Comments: 3925, Category: Standards Track, Cisco Systems, Inc., Oct. 2004, 9 pages.

H. Schulzrinne, *Dynamic Host Configuration Protocol (DHCPv4 and DHCPv6) Option for Civic Addresses Configuration Information draft-ietf-geopriv-dhcp-civil-05*, Columbia University, Feb. 19, 2004.

J. Polk et al., *Dynamic Host Configuration Protocol Option for Coordinate-based Location Configuration Information*, Network Working Group, Request for Comments: 3825, Category: Standards Track, Cisco Systems, Jul. 2004, 15 pages.

*EPC™ Tag Data Standards Version 1.1 Rev.1.24*, EPCglobal, Standard Specification, Apr. 1, 2004, 78 pages.

*Global Location Number (GLN) Implementation Guide*, Uniform Code Council, Inc., May 2002, 13 pages.

*The Global Language of Business*, http://www.ean-int.org/locations.html, printed Mar. 24, 2005, 5 pages.

* cited by examiner

| | 262 Header | 264 Filter Value | 266 Partition | 268 Company Prefix | 270 Location Reference | 272 Serial Number |
|---|---|---|---|---|---|---|
| SGLN-96 | 8 | 3 | 3 | 20-40 | 21-1 | 41 |
| | 0011 0010 (Binary value) | 8 (Decimal capacity) | 8 (Decimal capacity) | 999,999 – 999,999,999,999 (Decimal capacity*) | 999,999 – 0 (Decimal capacity*) | 2,199,023,255,552 (Decimal capacity) [Not Used] |

261

*Fig. 2B*

NAVIGATION AND COORDINATION DURING EMERGENCIES

BACKGROUND OF THE INVENTION

1. Field of the Invention

The present invention relates to the provision of emergency services, such as fire fighting, policing, military services and special operations. More specifically, the invention relates to providing location information for emergency service workers and for others who may be coordinating emergency service operations. Although the present invention will mainly be described in terms of fire fighting operations, it applies generally to many different types of emergency service operations.

2. Description of the Related Art

It can be challenging to determine the location of emergency service providers during an emergency service operation. For example, when fire fighters are in a building, they are generally not familiar with the layout of the building and may become disoriented. If the building is burning, smoke may make it difficult for a fire fighter to see clearly enough to distinguish the features of the building. Moreover, these features will change if parts of the building are consumed by fire.

Global Positioning System ("GPS") devices can be very useful for location and navigation, and therefore have become very popular in recent years. In years past, GPS devices would provide only a determination and display of X/Y or latitude/longitude information. This required a user to have a map and to be able to determine the user's position on the map according to the X/Y or latitude/longitude information. Moreover, the accuracy of a commercially available GPS device provided only a rough idea of a person's location, e.g., within approximately 100 meters.

GPS devices now provide greater accuracy and many are now provisioned with cartographic data. Such devices automatically provide a map display with the user's location indicated on the display. However, GPS devices still do not provide location information that is sufficiently accurate to navigate inside a building.

In addition, GPS devices do not provide displays of building layouts with a user's position indicated on the display. Moreover, GPS devices often do not function inside buildings. Under emergency conditions of fire, flood, earthquake, military operations, etc., there may be further disruption of GPS reception.

It may also be difficult to determine who was within a building prior to an emergency and who may still be in harm's way as the emergency unfolds. Even if it is known that certain people are still inside a building and need to be rescued, it can be difficult to locate these victims. During a fire victims may be unable to provide their location (e.g. via cellular telephone) because they are disoriented or have lost consciousness.

It would be desirable to locate emergency service providers and victims accurately and reliably during emergency operations, particularly when the emergency service providers and victims are within buildings.

SUMMARY OF THE INVENTION

The present invention includes methods and devices for locating emergency service providers during emergency operations. According to some implementations, radio frequency identification ("RFID") tags are positioned at various locations throughout a building. Building locations can be determined from the RFID tags. Emergency service providers may be equipped with a portable device that includes at least one RFID reader for reading the RFID tags. Some implementations involve transmitting the RFID tag data to a control center from which the emergency services are coordinated. The emergency service workers' current and prior locations can be determined by the portable devices and/or at the control center. In preferred implementations, emergency service provider location information can be provided to control center personnel and to emergency service providers in real time.

Some implementations provide access to recent data from RFID readers that are deployed within a building, e.g., for normal use by an enterprise. Data from these RFID readers can provide the identities and the last known locations of potential victims who were within the building at or near the time of the emergency and who may therefore need to be rescued. Victim location data, in connection with emergency service provider location information (past and present), allow informed responses to be made according to changing conditions.

Some aspects of the invention involve a method of providing emergency services. The method includes these steps: reading RFID tags that are positioned at each of a plurality of building locations; transmitting RFID tag data from the RFID tags to a control center; determining the building locations based on the RFID tag data; making emergency service decisions based on the building locations; and directing an emergency service operation according to the emergency service decisions. The directing step can involve communicating with emergency service workers inside the building.

The reading step may involve reading the RFID tags with a portable RFID reader. If so, the transmitting step may involve transmitting the RFID data via a wireless link. Some aspects of the method allow a first emergency service worker to use a portable device of a nearby second emergency service worker as a proxy for communication between the first emergency service worker and the control center.

The method may also include the steps of automatically determining searched areas of a building that have been traversed by emergency service workers and making emergency service decisions based on the searched areas. The method may involve automatically determining the last known location of an emergency service worker and making emergency service decisions based on the location. Alternatively, or additionally, the method may involve the following steps: searching a database of RFID reads of RFID tags assigned to individual people, the RFID reads uploaded by stationary RFID readers within the building; making determinations of the last known locations of the individual people according to the RFID reads; and making emergency service decisions based on the determinations.

The determining step may involve extracting building location data from the RFID data and/or searching a data structure that includes RFID data and corresponding building location data. At least some of the building locations may be displayed on a depiction of a building layout. The depiction of the building layout may be displayed in various locations, including the control center, a mobile command post. Some implementations cause the depiction of a building layout to be displayed to an emergency service worker, e.g. on an emergency service worker's visor and/or on a portable device.

Some embodiments of the invention provide an apparatus for providing emergency services. The apparatus includes the following elements: at least one RFID tag reader configured to read RFID tag data from RFID tags positioned at building locations; a wireless transmitter for transmitting RFID tag data to a control center; a speaker; a microphone; a wireless transceiver configured for voice communication with the control center via the speaker and microphone; and a mechanism for indicating building locations to a user based on the RFID tag data.

The indicating mechanism preferably includes a display device and may also include a logic device configured to control the display device to display building locations. The logic device may be further configured to determine building locations based on the RFID tag data. The logic device may also be configured to form instructions based on the building locations and to control the speaker to provide the instructions to the user in audible form.

The apparatus may also include at least one logic device configured to form a mesh between a first portable device and a nearby second portable device, thereby allowing the first portable device to use the second portable device as a proxy for communication between the first portable device and the control center.

Alternative embodiments of the invention disclose a network for providing emergency services. The network includes a plurality of portable devices, each of which has the following elements: an RFID reader; a wireless transmitter for transmitting RFID tag data to a control center, the RFID tag data being based upon RFID tags that are positioned at each of a plurality of building locations; a speaker; a microphone; and a wireless transceiver configured for voice communication with the control center via the speaker and microphone.

The control center includes the following: a receiver for receiving the RFID tag data; one or more devices for determining the building locations based on the RFID tag data; at least one computer for making emergency service decisions based on the building locations; and communication equipment for directing an emergency service operation according to the emergency service decisions.

The network may also include a logic device configured to determine searched areas of a building that have been traversed by emergency service workers. The computer can make emergency service decisions based on the searched areas. The network may also include a system for automatically determining the last known location of an emergency service worker.

The control center may also include the following: a database of RFID reads of RFID tags assigned to individual people, the RFID reads uploaded by stationary RFID readers within the building; and a network device configured to search the database and to make determinations of the last known locations of the individual people according to the RFID reads. The network device could be a host device, a server, etc., configured to extract location data from the RFID data and/or search a data structure that includes RFID data and corresponding location data. The computer can make emergency service decisions based on the determinations.

An alternative aspect of the invention involves another method of providing emergency services. The method includes these steps: reading RFID tags that are positioned at each of a plurality of building locations; determining the building locations based on the RFID tag data; and making emergency service decisions based on the building locations.

Still other embodiments of the invention provide computer programs embodied in machine-readable media. The computer programs include instructions for controlling one or more devices to perform the methods described herein.

BRIEF DESCRIPTION OF THE DRAWINGS

FIG. 2B illustrates the format of an EPC Serialized Global Location Number ("SGLN") 96-bit RFID tag.

DETAILED DESCRIPTION OF THE INVENTION

In this application, numerous specific details are set forth in order to provide a thorough understanding of the present invention. It will be obvious, however, to one skilled in the art, that the present invention may be practiced without some or all of these specific details. In other instances, well known process steps have not been described in detail in order not to obscure the present invention.

Figure 1:
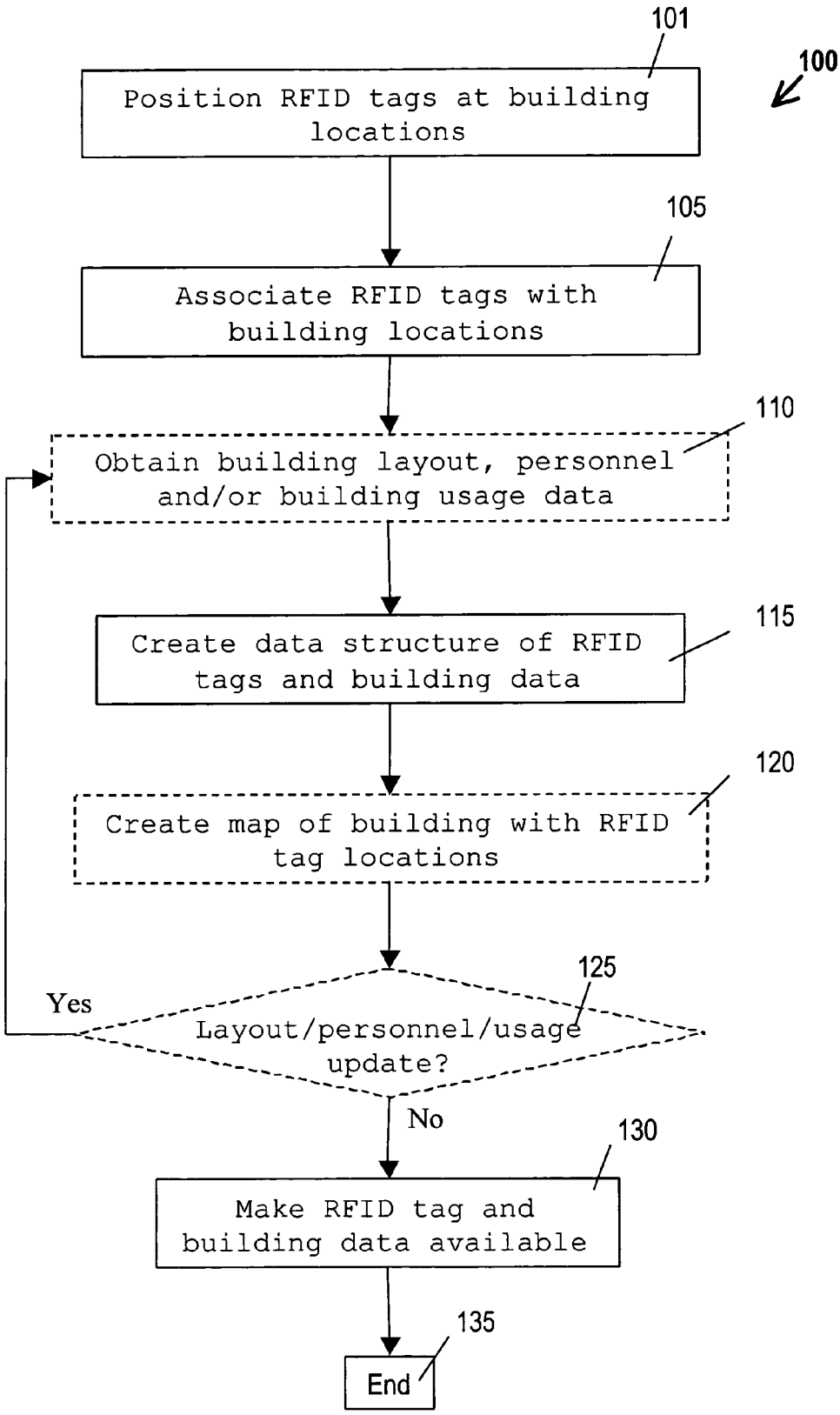
FIG. 1 is a flow chart that outlines some methods of the present invention.

The present invention includes methods and devices for locating emergency service providers during emergency operations. One such method 100 is illustrated by the flow chart of FIG. 1. The steps of method 100 (and the other methods described herein) are not necessarily performed in the order indicated. Moreover, some aspects of the invention involve similar methods having more or fewer steps. In step 101, RFID tags are positioned at various locations throughout a building.

Figure 2A:
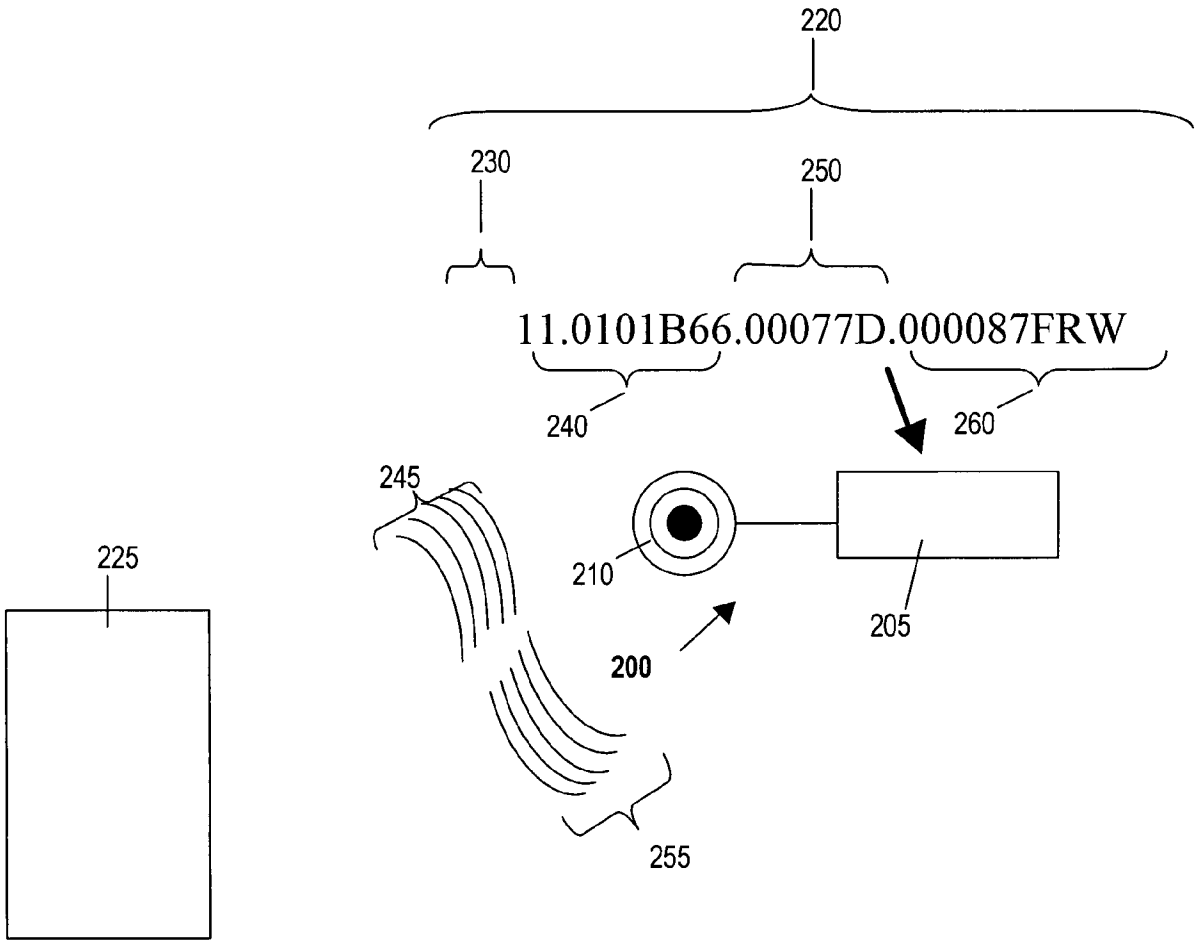
FIG. 2A is a diagram illustrating an RFID tag.

As shown in FIG. 2A, an RFID tag 200 includes microprocessor 205 and antenna 210. In this example, RFID tag 200 is powered by a magnetic field 245 generated by an RFID reader 225. The tag's antenna 210 picks up the magnetic signal 245. RFID tag 200 modulates the signal 245 according to information coded in the tag and transmits the modulated signal 255 to the RFID reader 225.

RFID tags use the Electronic Product Code ("EPC" or "ePC") format for encoding information. An EPC code includes a predetermined number of bits of information (common formats are 64, 96 and 128 bits), which allows for identification of individual products as well as associated information. As shown in FIG. 2A, EPC 220 includes header 230, EPC Manager field 240, Object Class field 250 and Serial Number field 260. EPC Manager field 240 contains manufacturer information. Object Class field 250 includes a product's stock-keeping unit ("SKU") number. Serial Number field 260 is normally a 40-bit field that can uniquely identify the specific instance of an individual product i.e., not just a make or model, but also down to a specific "serial number" of a make and model.

Returning to FIG. 1, in step 105, the RFID tags are associated with building locations. According to some implementations, the RFID tags positioned in step 101 include encoded building location information and therefore step 105 would be performed, at least in part, prior to step 101. In one such example, each RFID tag includes (among other things), a building identification number field, a floor number field and a building feature field that indicates an element or feature of the building. For example, the building feature field may indicate "doorway," "large conference room door," "corridor," "SE exit door" or the like.

Alternatively, or additionally, the RFID tags and building locations can be associated with one another in a data structure such as a table. (Step 115.) The data structure may indicate, for example, the last known usage of the building location (e.g., as an office, a conference room, a kitchen, a day care center, etc.). If room numbers are assigned within a portion of a building, such numbers are preferably added to the data structure.

The document entitled "EPCTM Tag Data Standards Version 1.1 Rev. 1.24, Standard Specification" (Apr. 1, 2004 EPCglobal®) ("Tag Data Standards"), which is hereby incorporated by reference for all purposes, describes relevant methods of encoding location information in RFID tags. These methods generally involve encoding one or more fields in an RFID tag that are used to reference location data stored elsewhere. However, some methods of the invention provide for encoding location information in an RFID tag in ways that generally conform to the formats described in the Tag Data Standards document.

FIG. 2B illustrates the format of an EPC Serialized Global Location Number 96-bit RFID tag ("SGLN-96"), as described in the Tag Data Standards document. Header field 262 indicates the type of RFID tag that follows, which is an SGLN-96 tag in this case.

Filter Value field 264 contains additional data that are currently used for fast filtering and pre-selecting certain tags. Partition field 266 indicates how many bits that follow are for Company Prefix field 268. Location Reference field 270 is an index into an array or a database, allowing RFID tag 261 to be used as a pointer to location data stored elsewhere. The capacity of Company Prefix field 268 and Location Reference field 270 vary according to the contents of Partition field 266. Serial Number field 272 is currently reserved, pending the finalization of a standard.

The 11 bits of Header field 262 and Filter Value field 264 are required to differentiate these location tags from all other EPC tags. However, Filter Value field 264 allows multiple formats for encoding the location information that follows. Accordingly, some implementations of the invention use predetermined and heretofore unassigned values of Filter Value field 264 to indicate that encoded location information follows. This allows considerable discretion regarding the assignment of the following 85 bits of tag 261. However, the location data should preferably be encoded into the tag using a globally significant format.

Figure 2C:
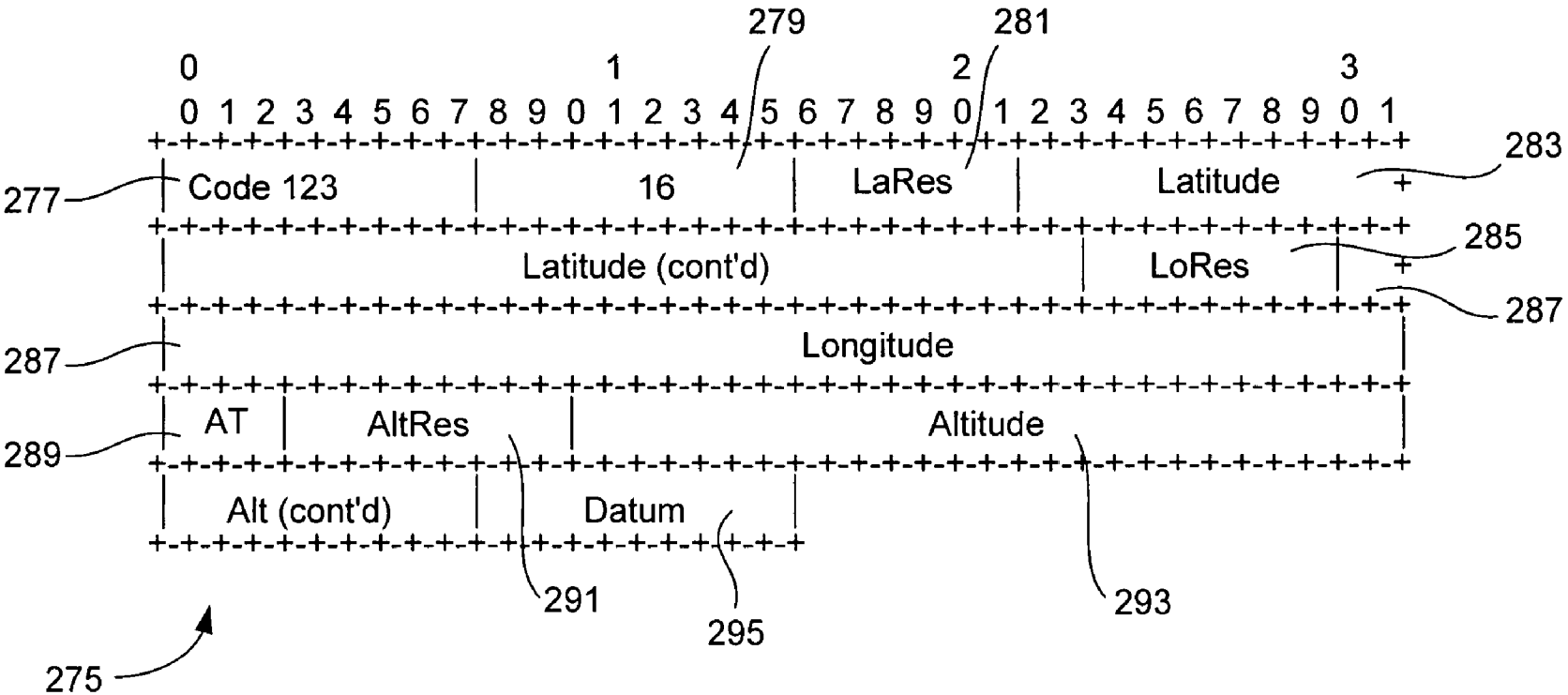
FIG. 2C illustrates the format of Location Configuration Information ("LCI") according to a DHCP Option defined in RFC 3825.

FIG. 2C illustrates one such format, which is the format of Location Configuration Information ("LCI") according to a Dynamic Host Configuration Protocol ("DHCP") Option defined in RFC 3825, which is hereby incorporated by reference for all purposes.

As presented in RFC 3825, the structure of LCI 275 requires a total of 144 bits. However, only 85 bits are available for encoding location data in an SGLN-96 tag modified according to some aspects of the invention. Therefore, some aspects of the invention reduce the number of bits of LCI structure 275 from 144 bits to no more than 85 bits.

For example, fields 277 and 279 are specific to DHCP. Eliminating these fields leaves 128 bits. Datum field 295 is an 8-bit field that allows for the specification of up to 256 positioning coordinate systems to be used. If we choose a single datum (e.g., WGS 84), Datum field 295 would not be needed. This reduces LCI 275 to 120 bits.

AT field 289 currently provides for a wide variety of altitude designations. AT field 289 field could be reduced from 4 bits to 1 bit, e.g., by allowing altitude to be specified only as meters or floors.

Longitude field 287 can be reduced from 34 bits to 31 bits while still providing a positioning error of less than +/−2 cm. Latitude can be represented in 8 bits of integer, rather than the 9 bits that are specified in RFC 3825, because Latitude will only range within +/−90 degrees. Therefore, Latitude field 283 can be reduced from 34 bits to 30 bits while providing a positioning error of less than +/−2.5 cm. Six-bit Latitude and longitude resolution fields LaRes 281 and LoRes 285 can be replaced with a single 2-bit "Lres" field, providing a savings of 10 bits.

AltRes (altitude resolution) field 291 could be reduced to 2 bits, e.g., by indicating one of 4 predetermined resolutions. Moreover, because the highest point on Earth is no more than 8,900 m, the deepest mine is currently about 5,000 m and the deepest ocean is about 11,000 m, the 22 bit integer part of altitude field 293 can be reduced to 14 bits. Overall, Altitude field 293 could be reduced from 30 to 19 bits while providing an accuracy of +/−3.12 cm. or 1/32 floor and allowing up to +/−16,384 m or floors to be represented.

Taken together, the foregoing modifications reduce the size of LCI 275 from 144 bits to 85 bits. Accordingly, location information can be encoded in the remaining 85 bits of tag 261 (FIG. 2B) using a globally significant format.

Building layouts, room assignments, etc., are often changed. Therefore, in optional step 110, current building usage data and personnel data are obtained. In such implementations, the data structure is also populated with personnel data. For example, the identity of the person using a particular office will be associated with the office in the data structure.

Some data structures of the present invention are readable by a computer-aided drafting ("CAD") program such as those commercially available for architects, thereby allowing data to be spotted on a display of a building layout, a map, etc. (Optional step 120.) The data structure (and the display) could also indicate, for example, where there is a gas main.

If there are changes to the building layout, usage or personnel assignments within the building, it is preferable that updates are obtained (e.g., from HR personnel of the enterprise(s) located in the building). (Optional steps 125 and 110.) In some instances, a remodel or similar update may cause previously-positioned RFID tags to be removed, to be inadequate, and/or may render the previous building information associated with an RFID tag to be obsolete. In such instances, the process returns to step 101 and additional RFID tags are positioned.

In step 130, the RFID tag data and associated building data are made available. The term "building data" is used broadly herein to include, but not to be limited to, building layout, personnel and building usage data. These data may be provided in various ways, as set forth in more detail below with reference to FIGS. 3–5.

Figure 3:
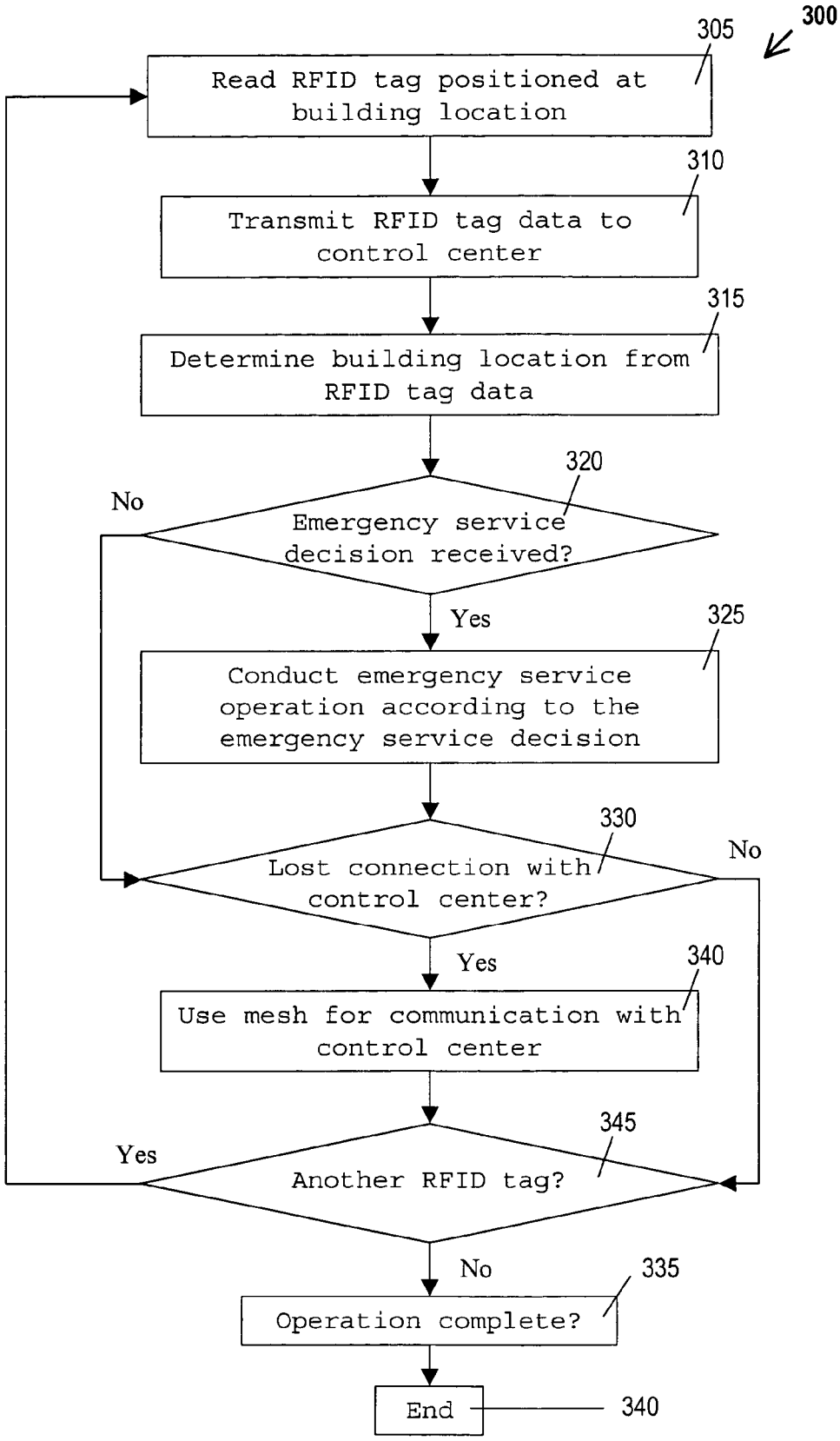
FIG. 3 is a flow chart that outlines another method of the present invention.

FIG. 3 is a flow chart that outlines method 300 of the invention. Method 300 is mainly performed by one or more emergency service providers, such as police officers, soldiers, fire fighters, etc. Although the following examples are mainly described in terms of fire fighting operations, the invention applies generally to many different types of emergency service operations.

In preferred implementations of method 300, fire fighters are equipped with a portable device that includes at least one RFID reader for reading the RFID tags. One such portable device is portable device 600, which is described below with reference to FIG. 6. Accordingly, in step 305, a fire fighter has responded to a fire alarm, has entered a building and his portable device is reading one of the RFID tags positioned according to method 100.

Some preferred implementations of the invention involve transmitting the RFID tag data to one or more control centers from which the emergency services are coordinated, which may be a building, a mobile command post (such as a fire chief's vehicle), etc. (Step 310.) The fire fighter is equipped with a wireless transmitter for transmitting the RFID tag data. The transmitter may be part of the portable RFID reader and may be one mode of a transceiver. Preferably, the fire fighter also has a wireless transceiver for voice communication, which may or may not be part of the portable RFID reader.

In some implementations, fire fighters can obtain at least some building data from the RFID tags. (Step 315.) According to some such implementations, building data (including the sort of data structure described above) have recently been downloaded to the fire fighter's portable device. When the portable device reads an RFID tag that corresponds to a building location, in step 315 the RFID device will correlate the RFID tag data with data in the data structure to obtain, e.g., building usage data, personnel assignments, etc. For example, a fire fighter may determine that she is near an office assigned to Patricia Adams on the north side of the building.

However, in other implementations, the associations between RFID tag data and building data are made by a control center and are then communicated to the fire fighters. The building data may be communicated to the fire fighter in various ways. For example, building data and/or emergency service decisions (step 320) may be communicated to the fire fighter by voice instructions from a control center. This information may be conveyed, for example, by the wireless voice transceiver and one or more speakers of a headset. Alternatively, building data may be conveyed via audio instructions from the portable device.

Building data and/or emergency service decisions may also be communicated to the fire fighter by a display (e.g., a building layout displayed in goggles or a visor) controlled by the portable device and/or a control center. Similar displays may be made on one or more display devices accessible by control center personnel such as a dispatchers, a fire chief, etc. Preferably, the display indicates a building layout and the last known locations of the fire fighters. In some implementations, the display optionally depicts the last known locations of potential victims who were known to be recently inside the building.

Emergency service decisions will be rendered by the control center personnel and/or by the fire fighters themselves (step 320), and the emergency service operation will be conducted accordingly. (Step 325.) For example, when a fire fighter goes down, the last known location of the fire fighter is known by a fire chief in a mobile control center according to the most recent RFID reads from that fire fighter. This information will be used to make a decision to rescue the injured fire fighter (step 320) and to guide other fire fighters to rescue the injured one. (Step 325.)

In some implementations, the reads from a portable device will also be forwarded to one or more other fire fighters, e.g., to a first fire fighter and the closest second fire fighter, when a fire fighter signals that he needs assistance. This information provides a back-up plan to the normal "command and control" procedure directed by the fire chief.

In this exemplary implementation, fire fighters also have a back-up or fail safe connection with the control center(s). Here, in step 330, it is determined (e.g., by a processor of a portable device) whether a connection with the control center has been lost. If so, the portable device forms a "mesh" with a nearby portable device of another fire fighters to allow continued communication with the command and control center by using the nearby portable device as a proxy. Finding a proxy can be accomplished by, e.g., using Bluetooth.™ Some implementations of the invention use the Zigbee mesh networking standard that has been developed for various applications and is hereby incorporated by reference.

If the operation is continuing, the fire fighter will continue to encounter RFID tags (step 345), which will be read and transmitted to the control center. If the operation is complete, the process ends. (Step 340.)

Figure 4:
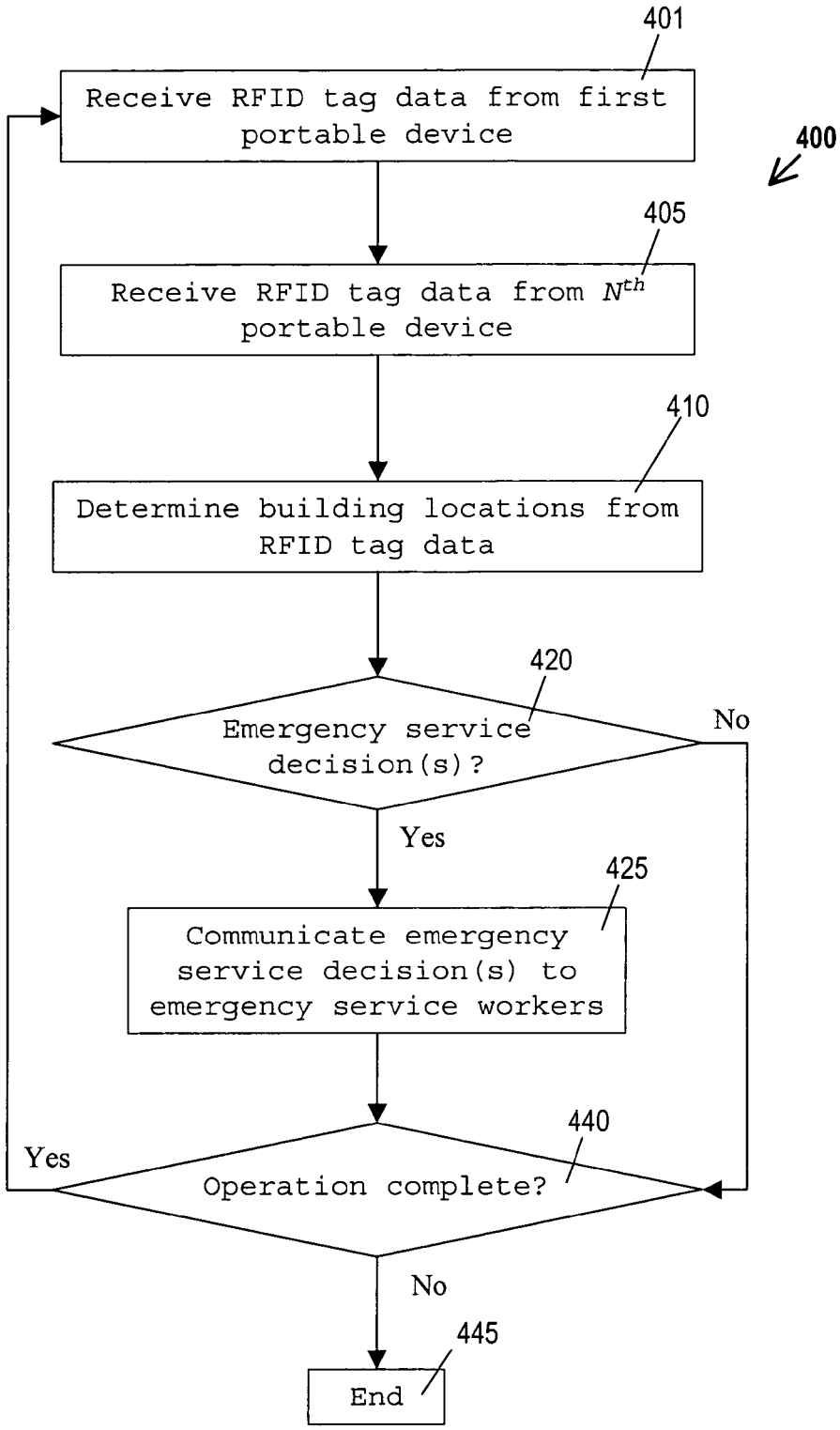
FIG. 4 is a flow chart that outlines still another method of the present invention.

FIG. 4 is a flow chart that outlines method 400, which is a similar process as seen from the viewpoint of a control center, which may be a building, a vehicle, etc. In steps 401 and 405, the control center receives RFID tag data from the first through $N^{th}$ portable RFID readers during an emergency operation, which in this example involves N fire fighters in a burning building. It will be appreciated that steps 401 and 405 could also be depicted as a single step, N steps, etc. It will also be appreciated that multiple reads may be received for 1 of the N devices before any are received for another and that the reads will not necessarily arrive in any particular order. Accordingly, it is preferred for each of the RFID reads to include an identification of the transmitting device.

In step 410, building locations are determined according to the RFID tag data for each of the N devices. As noted above, these building locations may be correlated with other data, such as building usage, fire fighter location and personnel data, to make emergency service decisions. (Step 420.) When such decisions are made, they are communicated to the fire fighters (step 425). As noted above, in some implementations the fire fighters also rely on the control center to provide them with building data, possibly including location data.

If the operation is ongoing, more RFID tag data will be received as the fire fighters continue to navigate their way through the building and the process returns to steps 401 and 405. If the operation is complete (step 440), the process ends (step 445).

Figure 5:
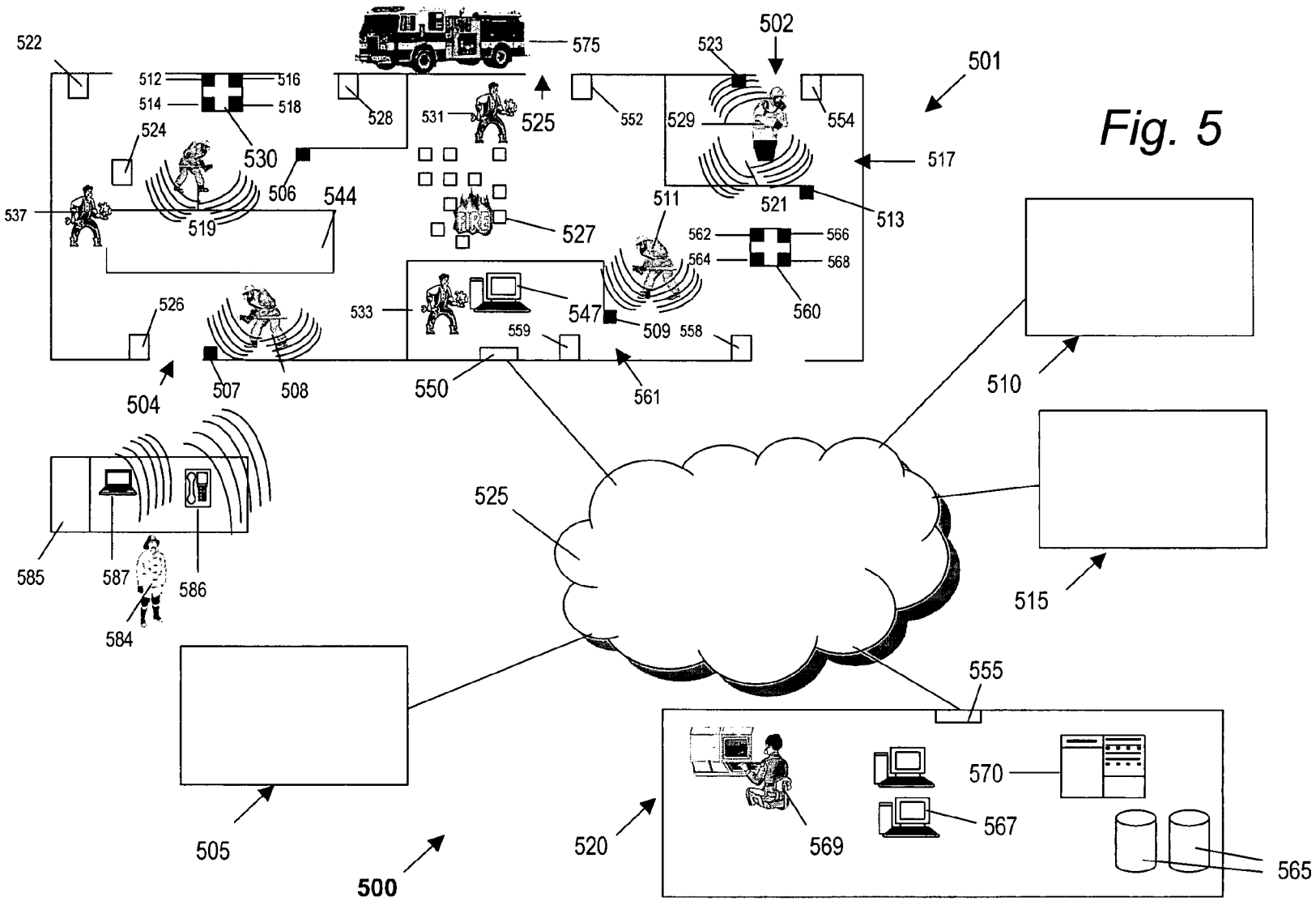
FIG. 5 is a network diagram illustrating one implementation of the present invention.

FIG. 5 is a network diagram that illustrates one embodiment of the present invention. Here, network 500 includes warehouse 501, office building 505, retail outlet 510, fire station 515 and control center 520. As will be appreciated by those of skill in the art, network 500 could include many other elements and/or multiple instances of the elements shown in FIG. 5.

RFID tags, including RFID tags 506, 507, 509, 513 and 523, have previously been positioned in various locations of the buildings illustrated in network 500. As noted elsewhere, these RFID tags indicate (directly or indirectly) the location of the tag with respect to some feature of warehouse 510. For example, RFID tag 523 indicates that it is positioned near door 502 of warehouse 501. These data are organized into a data structure, such as a look-up table, and stored in storage devices 565 of control center 520.

In this example, the information from RFID tag 523 has been correlated with building layout data that have previously been provided to control center 520, thereby allowing a correlation of RFID tag 523 and the current usage of room 517 as a day care center. Such building layout data, building usage and personnel data are also stored in storage devices 565.

RFID reader 552 is connected to port 562 of switch 560. RFID reader 554 is connected to port 566 of switch 560, RFID reader 558 is connected to port 568 of switch 560 and RFID reader 559 is connected to port 564 of switch 560. Similarly, RFID readers 522, 524, 526 and 528 are connected to ports 512, 514, 516 and 518, respectively, of switch 530.

Here, switches 530 and 560 are connected to the rest of RFID network 500 via gateway 550 and network 525. Network 525 could be any convenient network, but in this example network 525 is the Internet. U.S. patent application Ser. No. 11/010,089, filed Dec. 9, 2004 and entitled "Methods and Devices for Providing Scalable RFID Networks" and U.S. patent application Ser. No. 10/866,285, filed Jun. 9, 2004 and entitled "Methods and Devices for Assigning RFID Device Personality" (collectively, the "RFID Network Applications") contain relevant subject matter and are hereby incorporated by reference.

The RFID readers installed in each building read each nearby RFID tag. For example, RFID reader 552 reads each nearby product RFID tag and each RFID tag carried by a worker. RFID reader 552 reads the RFID tag of each person or product that passes through door 525 and transmits the corresponding EPC code to switch 560.

RFID readers disposed in the buildings of network 500 provide updates regarding the last known location of persons within the buildings. For example, RFID reader 552 has recently read an RFID tag assigned to worker 531. Because the locations of the RFID readers are known, it is determined that worker 531 was recently in the area of door 525. RFID reader 524 has recently detected an RFID tag assigned to worker 537. Therefore, it is determined that worker 537 was recently in the location of assembly area 544.

Similarly, because RFID reader 559 has recently detected an RFID tag assigned to worker 533, it is determined that worker 533 was recently in the vicinity of doorway 561. In this example, the location of worker 533 is further indicated by his recent communications over network 525 via desktop computer 547.

At least some of the "reads" from installed RFID readers are forwarded to gateway 555 of control center 520, where they are stored in storage devices 565. The data are then available, for example, to dispatcher 569 and mobile command center 585, which is a vehicle equipped with communication devices. Here, dispatcher 567 is in communication with network 525, server rack 570 and storage devices 565 via one of workstations 567. Server rack 570 contains a plurality of servers for providing various functions, including authentication, file sharing and file management, particularly for data stored in storage devices 565. Preferably, middleware filters out other RFID data, such as product data, before forwarding these data to storage devices 565 or other parts of network 500. In some implementations, middleware implemented in each building (e.g., in switch 560 and other switches of warehouse 501) filters out other RFID data prior to forwarding RFID reads from installed readers to control center 520.

In this illustration, products 527 have been delivered to warehouse 501 through door 525. Some of products 527 have subsequently caught fire and workers in warehouse 501 called 911 for help.

Soon thereafter, fire fighters arrived on the scene in truck 575 and other vehicles. Fire fighters 508, 511, 519 and 521 are inside warehouse 501, looking for victims and attempting to determine the source of the fire. Fire fighters 508, 511, 519 and 521 are all equipped with portable devices that include mobile RFID readers for reading RFID tags that indicate building locations, such as RFID tags 506, 507, 509, 513 and 523. Examples of such portable devices are described elsewhere herein. In this implementation of the invention, the fire fighters can download recent versions of building layout data, building usage data and personnel data to their portable devices prior to arriving at the scene (or en route to the scene).

In this example, fire chief 584 arrived in mobile command center 585, which is a vehicle equipped with communication devices. Fire chief 584 is in communication with dispatcher 569 and fire fighters 508, 511, 519 and 521 via push-to-talk radio 586. Fire chief 584 is also in wireless communication with control center 520 and fire fighters 508, 511, 519 and 521 via portable host device 587.

RFID reads from portable devices worn by fire fighters 508, 511, 519 and 521 are transmitted to portable host device 587. In this example, the portable devices add an indication (e.g., a header) that a particular RFID read is being transmitted by a particular RFID reader. By knowing what reader is assigned to what fire fighter, this information allows a fire fighter's location to be determined with reference to locations within warehouse 501.

In this example, a display of portable host device 587 indicates the layout of warehouse 501, including the usage of various portions of warehouse 501. The display also indicates the last known locations of fire fighters 508, 511, 519 and 521 by "spotting" the locations of the most recently read RFID tags inside warehouse 501. Fire chief 584 can make emergency service decisions based on these and other data. For example, fire chief 584 can decide what areas still need to be searched according to the areas already covered by fire fighters 508, 511, 519 and 521, as well as other factors that include the known usage of the areas of warehouse 501, the most recent locations of potential victims inside the building, descriptions received from the fire fighters, etc.

Here, fire chief 584 has previously received reads of RFID tags 513 and 523 from fire fighter 521. Fire chief 584 has previously received building usage data that indicate that these RFID tags are positioned in the doorways of room 517, which is a day care center. Therefore, fire chief 584 has informed fire fighter 521 that she is in a day care center. Provided with this information, fire fighter 521 has carefully searched day care center 517 and is in the process of rescuing infant 529.

Figure 6:
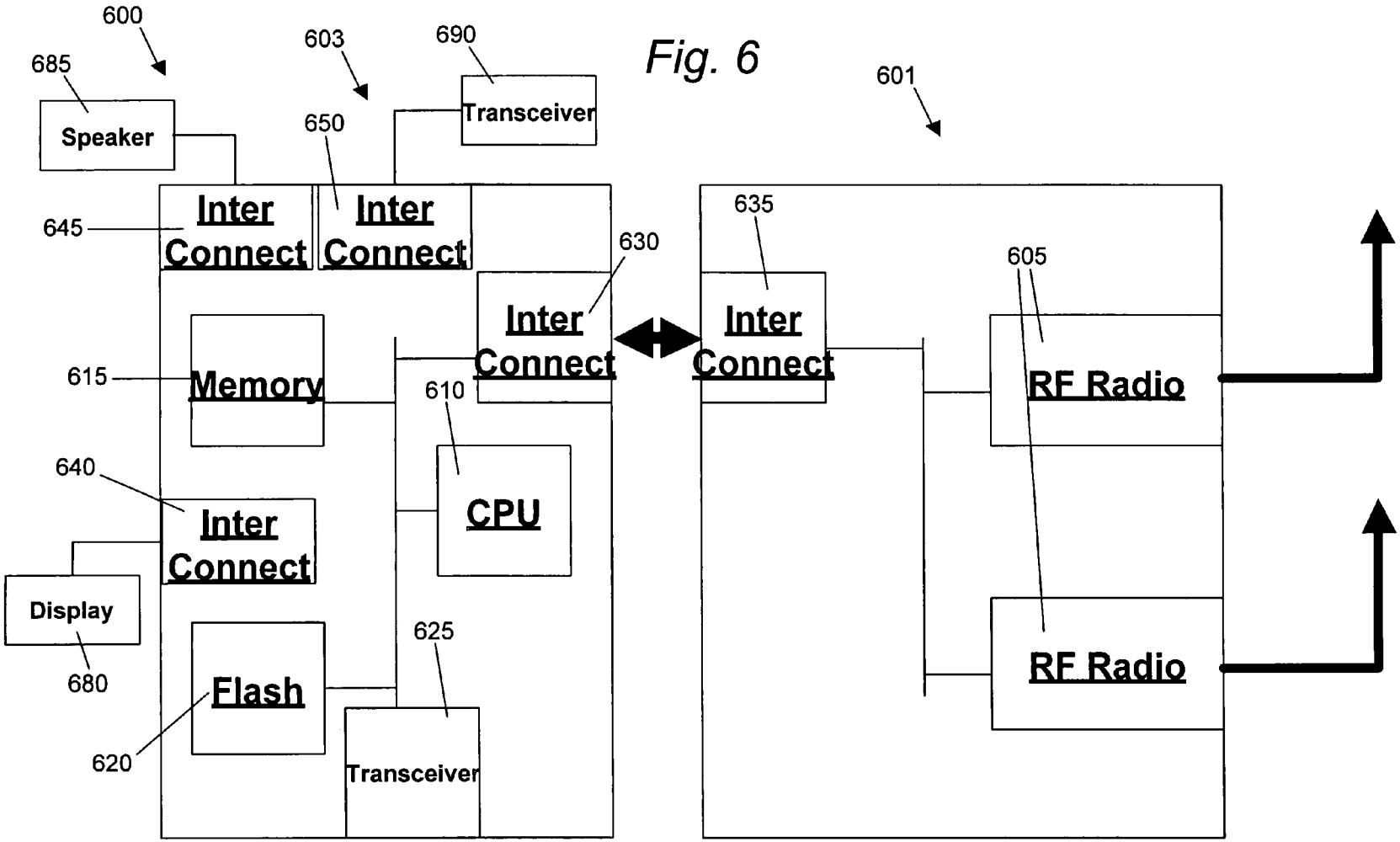
FIG. 6 is a block diagram that illustrates one embodiment of a portable device that may be configured to perform some methods of the present invention.

FIG. 6 illustrates portable device 600, including controller 603 and a "stripped down" version of RFID reader portion 601. Here, the intelligence for controlling RFID reader 601 resides in controller 603. In other embodiments, RFID reader 601 includes memory and at least one logic device for performing some or all of the functions of controller 603.

RFID reader 601 includes one or more RF radios 605 for transmitting RF waves to, and receiving modulated RF waves from, RFID tags. RF radios 605 provide raw RF data that is conveyed to controller 603 and converted by an analog-to-digital converter (not shown).

Interconnect 630 of controller 603 is configured for communication with interconnect 635 of RFID reader portion 601. In this example, interconnects 640, 645 and 650 provide communication between controller 603 and display 680, speaker 685 and transceiver 690, respectively. The communication may be via any convenient medium and format, such as wireless, serial, point-to-point serial, etc.

Transceiver 690 may be part of a radio device that has a separate microphone, speaker(s) and/or headset. In this implementation, the device is a push-to-talk radio configured for voice communication with a control center and other portable devices 600.

Transceiver 625 may be any convenient type of wireless device configured for transmitting RFID tag data from RFID reader 601 to a control center and/or other portable devices 600. Preferably, CPU 610 filters out RFID tag data from RFID tags that do not provide building data. For example, CPU 610 preferably filters out RFID tag data from commercial products and does not transmit these data on transceiver 625. In some preferred implementations, RFID tag data are temporarily stored in memory 415 and then filtered by CPU 610 prior to being transmitted.

In some implementations, portable device 600 can also receive building data from a control center and/or other portable devices 600 via transceiver 625. Some embodiments of controller 603 include interconnects that are specially configured for downloading building data, e.g., from a docking device like that used for personal digital assistants. These data may be stored, at least temporarily, in memory 415 and used by CPU 610 to indicate building or related information to a user, e.g., by producing a building layout on display 680, by providing audio information via speaker 685, or otherwise. In this example, CPU 610 controls portable device 600 and other attached devices according to software stored in local memory.

Although only one RFID reader portion 601 is depicted in FIG. 6, some embodiments of the present invention include multiple RFID readers 601. Each controller 603 may control a plurality of RFID readers 601. For example, an emergency service provider may have 2 or more RFID readers 601 attached to his or her gear, e.g., clipped to a belt or to a harness.

Flash memory 620 may be used to store a program (a "bootloader") for booting/initializing controller 603. The bootloader is usually stored in a separate, partitioned area of flash memory 620. In some implementations, flash memory 620 is used to store personality information and other configuration information.

Figure 7:
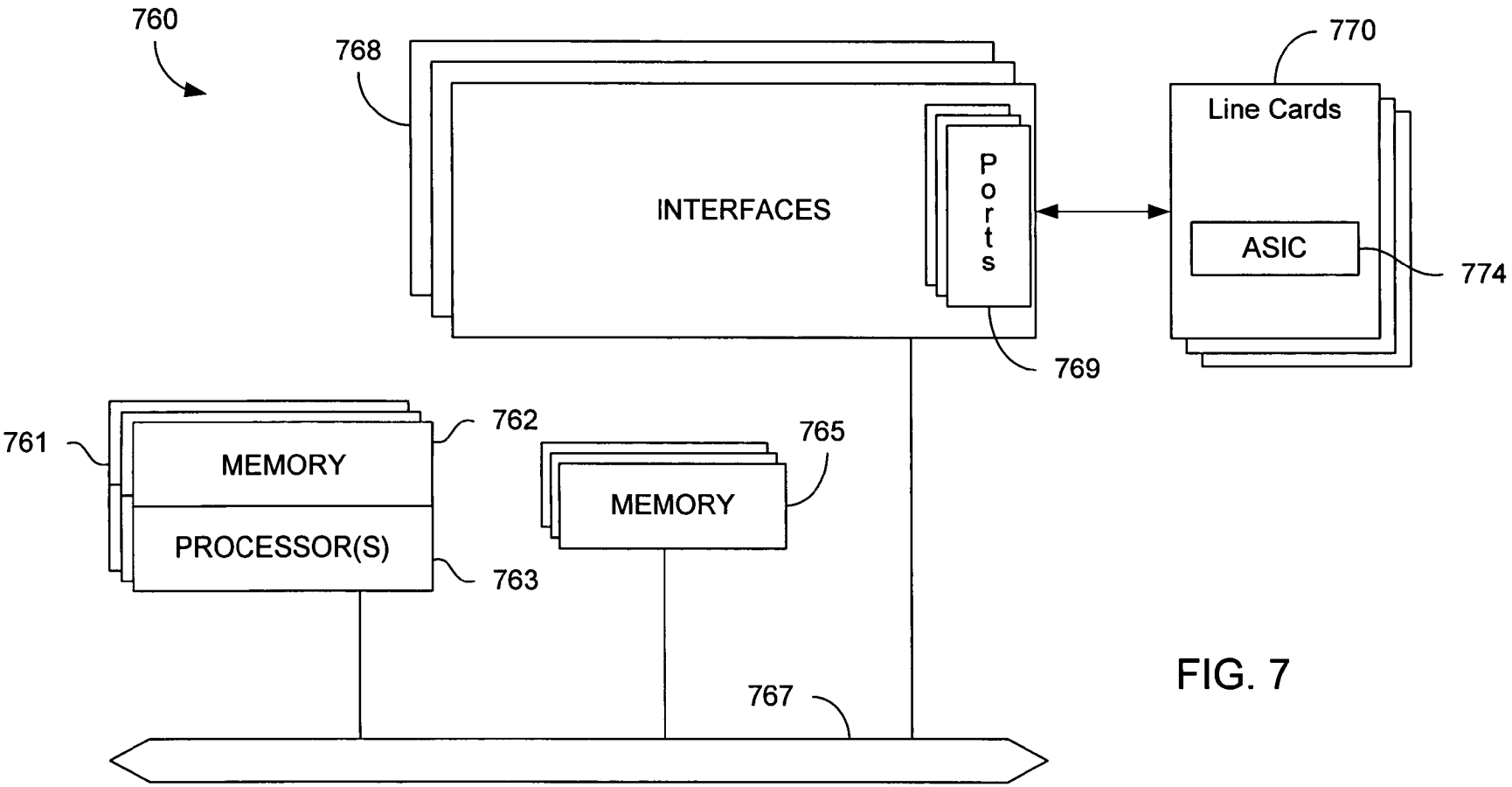
FIG. 7 illustrates an example of a network device that may be configured to implement some methods of the present invention.

FIG. 7 illustrates an example of a network device that may be configured to implement some methods of the present invention. Network device 760 includes a master central processing unit (CPU) 762, interfaces 768, and a bus 767 (e.g., a PCI bus). Generally, interfaces 768 include ports 769 appropriate for communication with the appropriate media.

The interfaces 768 are typically provided as interface cards (sometimes referred to as "line cards") 770. Generally, line cards 770 control the sending and receiving of data packets over the network and sometimes support other peripherals used with the network device 760. Among the interfaces that may be provided are Fibre Channel ("FC") interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

In some embodiments, one or more of line cards 770 includes at least one independent processor 774 and, in some instances, volatile RAM. Independent processors 774 may be, for example ASICs or any other appropriate processors. According to some such embodiments, these independent processors 774 perform at least some of the functions of the logic described herein. In some embodiments, one or more of interfaces 768 control such communications-intensive tasks as media control and management. By providing separate processors for the communications-intensive tasks, line cards allow the master microprocessor 762 efficiently to perform other functions such as routing computations, network diagnostics, security functions, etc.

When acting under the control of appropriate software or firmware, in some implementations of the invention CPU 762 may be responsible for implementing specific functions associated with the functions of a desired network device. According to some embodiments, CPU 762 accomplishes all these functions under the control of software including an operating system (e.g. Linux, VxWorks, etc.), and any appropriate applications software.

CPU 762 may include one or more processors 763 such as a processor from the Motorola family of microprocessors or the MIPS family of microprocessors. In an alternative embodiment, processor 763 is specially designed hardware for controlling the operations of network device 760. In a specific embodiment, a memory 761 (such as non-volatile RAM and/or ROM) also forms part of CPU 762. However, there are many different ways in which memory could be coupled to the system. Memory block 761 may be used for a variety of purposes such as, for example, caching and/or storing data, programming instructions, etc.

Regardless of network device's configuration, it may employ one or more memories or memory modules (such as, for example, memory block 765) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher level code that may be executed by the computer using an interpreter.

Although the system shown in FIG. 7 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces/line cards may be bus based (as shown in FIG. 7) or switch fabric based (such as a cross-bar).

OTHER EMBODIMENTS

Although illustrative embodiments and applications of this invention are shown and described herein, many variations and modifications are possible which remain within the concept, scope, and spirit of the invention, and these variations would become clear to those of ordinary skill in the art after perusal of this application. In some such alternative implementations, RFID tags positioned in a building are used for other types of navigation, such as to determine whether a self-guided robot has cleaned all areas of a building. For example, the robots can be provided with one or more RFID readers, a processor for interpreting RFID tag data and determining building locations, and a memory for storing locations already traversed by the robot. The processor could direct the robot according to both the current building location and the locations already traversed.

Accordingly, the present embodiments are to be considered as illustrative and not restrictive, and the invention is not to be limited to the details given herein, but may be modified within the scope and equivalents of the appended claims.

We claim:

1. A method of providing emergency services, the method comprising:

reading radio frequency identification ("RFID") tags that are positioned at each of a plurality of building locations;

transmitting RFID tag data from the RFID tags to a control center;

determining the building locations based on the RFID tag data by searching a data structure that includes RFID tag data and corresponding building location data;

automatically determining the building locations of at least one emergency service worker;

making emergency service decisions based on the building locations; and directing an emergency service operation according to the emergency service decisions.

2. The meted of claim 1, wherein the reading step comprises reading the RFID tags with a portable RFID reader and wherein the transmitting step comprises transmitting the RFID data via a wireless link.

3. The method of claim 1, further comprising:

automatically determining searched areas of a building that have been traversed by emergency service workers; and making emergency service decisions based on the searched areas.

4. The method of claim 1, wherein the directing step comprises communicating with emergency service workers inside the building.

5. The method of claim 1, further comprising:

searching a database of RFID reads of RFID tags assigned to individual people, the RFID reads uploaded by stationary RFID readers within the building;

making determinations of the last known locations of the individual people according to the RFID reads; and making emergency service decisions based on the determinations.

6. The method of claim 1, further comprising the step of using, by a first emergency service worker, a portable device of a nearby second emergency service worker as a proxy for communication between the first emergency service worker and the control center.

7. The method of claim 1, further comprising the step of displaying at least some of the building locations on a depiction of a building layout.

8. The method of claim 7, wherein the depiction of a building layout is displayed at the control center.

9. The method of claim 7, wherein the depiction of a building layout is displayed to an emergency service worker.

10. The method of claim 9, wherein the depiction of a building layout is displayed on an emergency service worker's visor.

11. An apparatus for providing emergency services, the apparatus comprising:

at least one radio frequency identification ("RFID") tag reader configured to read RFID tag data from RFID tags positioned at building locations;

a wireless transmitter for transmitting RFID tag data to a control center;

a speaker;

a microphone;

a wireless transceiver configured for voice communication with the control center via the speaker and microphone;

means for determining the locations based on the RFID tag data by searching a data structure tat includes RFID tag data and corresponding building location data; and means for indicating the building locations and emergency service decisions based on the building locations to a user.

12. The apparatus of claim 11, wherein the indicating means comprises a display device.

13. The apparatus of claim 11, wherein the determining means comprises a logic device.

14. The apparatus of claim 11, further comprising means for forming a mesh between a first portable device and a nearby second portable device, thereby allowing the first portable device to use the second portable device as a proxy for communication between the first portable device and the control center.

15. The apparatus of claim 13, wherein the logic device is further configured to form instructions based on the building locations and to control the speaker to provide the instructions to the user in audible form.

16. The apparatus of claim 13, wherein the indicating means comprises a display device and wherein the logic device is further configured to control the display device to display building locations.

17. A network for providing emergency services, the network comprising:

a plurality of portable devices, each of the plurality of portable devices comprising:

a radio frequency identification ("RFID") reader;

a wireless transmitter for transmitting RFID tag data to a control center, the RFID tag data being based upon RFID tags that are positioned at each of a plurality of building locations;

a speaker;

a microphone;

a wireless transceiver configured for voice communication with the control center via the speaker and microphone; and a control center, comprising:

a receiver configured to receive the RFID tag data;

determining means for determining the building locations of at least one portable device based on the RFID tag data by searching a data structure that includes RFID tag data and corresponding building location data;

decision means for making emergency service decisions based on the building locations; and communication means for directing an emergency service operation according to the emergency service decisions.

18. The network of claim 17, further comprising means for determining searched areas of a building that have been traversed by emergency service workers, wherein the decision means makes emergency service decisions based on the searched areas.

19. The network of claim 17, wherein the control center further comprises:

means for searching a database of RFID reads of RFID tags assigned to individual people, the RFID reads uploaded by stationary RFID readers within the building; and means for making determinations of the last known locations of the individual people according to the RFID reads; wherein the decision means is further configured to make emergency service decisions based on the determinations.

20. The network of claim 17, wherein the portable devices comprise one of means for extracting location data from the RFID data and means for searching a data structure that includes RFID data and corresponding location data.

21. A method of providing emergency services, the method comprising:

reading radio frequency identification ("RFID") tags that are positioned at each of a plurality of building locations;

determining the building locations based on the RFID tag data by searching a data structure that includes RFID tag data and corresponding building location data;

automatically determining the building locations of at least one emergency service worker; and making emergency service decisions based on the building locations.

* * * * *